United States Patent [19]

Mattiebe

[11] Patent Number: 5,057,180

[45] Date of Patent: Oct. 15, 1991

[54] APPARATUS FOR FEEDING A PREFERABLY MULTI-PLY WEB OF SYNTHETIC THERMOPLASTICS

[75] Inventor: Gunter Mattiebe, Bielefeld, Fed. Rep. of Germany

[73] Assignee: Windmoller & Holscher, Lengerich, Fed. Rep. of Germany

[21] Appl. No.: 441,120

[22] Filed: Nov. 27, 1989

[30] Foreign Application Priority Data

Dec. 6, 1988 [DE] Fed. Rep. of Germany ..... 3841049
Mar. 14, 1989 [DE] Fed. Rep. of Germany ..... 3808272

[51] Int. Cl.[5] ..... B32B 27/00; B32B 31/00

[52] U.S. Cl. ..... 156/352; 156/515; 201/262; 493/194

[58] Field of Search ..... 156/515, 350, 352; 226/97; 493/194, 199, 203, 204; 221/262, 263

[56] References Cited

U.S. PATENT DOCUMENTS

| | | | |
|---|---|---|---|
| 3,722,773 | 3/1973 | Plate et al. | 493/204 |
| 4,390,118 | 6/1983 | Gardner, Jr. | 271/263 |
| 4,459,172 | 7/1984 | Achelpohl et al. | 493/204 |
| 4,462,585 | 7/1984 | Gieson et al. | 271/263 |

*Primary Examiner*—David A. Simmons
*Assistant Examiner*—John Pentikis
*Attorney, Agent, or Firm*—Fleit, Jacobson, Cohn, Price, Holman & Stern

[57] ABSTRACT

An apparatus for feeding a preferably multi-ply web of synthetic thermoplastics comprises a pair of feed rolls, which define a feeding nip and each of which is formed with annular grooves, and two scraping rakes, which are secured in the frame and have tines extending through the annular grooves, wherein at least one of said rakes is movably mounted and arranged to actuate a switch for stopping the drive for the rolls when the scraping rake is moved out of its normal position by the web because it is bulged. It is intended so to improve such an apparatus that the switch will be operated even by relatively small bulges formed in the web. That object is accomplished in that each scraping rake is guided to be movable in the direction of travel of the web. A scraping rake for actuating the switch can be moved by a much weaker force if the rake is displaced in the direction of travel of the web rather than being pivotally moved. The apparatus in accordance with the invention is capable of a much more sensitive response to a bulging of the web than known apparatuses.

7 Claims, 2 Drawing Sheets

APPARATUS FOR FEEDING A PREFERABLY MULTI-PLY WEB OF SYNTHETIC THERMOPLASTICS

BACKGROUND OF THE INVENTION

1. Field of the Invention

This invention relates to an apparatus for feeding a preferably multi-ply web of synthetic thermoplastics, which apparatus comprises a pair of feed rolls, which define a feeding nip and each of which is formed with annular grooves, and two scraping rakes, which are secured in the frame and have tines extending through the annular grooves, wherein at least one of said rakes is movably mounted and arranged to actuate a switch for stopping the drive for the rolls when the scraping rake is moved out of its normal position by the web because it is bulged.

2. Description of the Prior Art

German Utility Model 72 32 187 discloses an apparatus which is of the kind described hereinbefore and in which a rake is connected on both sides to arms, which by means of shafts are pivoted to the frame of the machine. At least one of said shafts carries a second arm, which is supported by a compression spring and which is pivotally movable against the force of the compression spring to actuate a microswitch. When the web moving through the feeding nip of the pair of rolls is bulged, that web will urge the pivoted upper scraping rake upwardly so that the microswitch is acturated to stop the drive for the feed rolls. It has been found in practice that in the operation of the known apparatus a considerable bulge in the web will be required before the scraping rake can be sufficiently deflected to actuate the microswitch. But it will be difficult to service the apparatus and to eliminate a defect when a considerable bulge must be eliminated after the microswitch has been actuated.

SUMMARY OF THE INVENTION

For this reason it is an object of the invention to provide an apparatus which is of the kind described first hereinbefore and in which the switch will be actuated even in response to a relatively small bulge in the web.

In an apparatus which is of the kind described first hereinbefore that object is accomplished in that each scraping rake is guided to be movable against spring force in the direction of travel of the web. A scraping rake for actuating the switch can be moved by a much weaker force if the rake is displaced in the direction of travel of the web rather than being pivotally moved. This result is presumably due to the fact that the full actuating force will be exerted by the web in its direction of travel whereas only a component of force acting substantially at right angles to the direction of travel will be effective for imparting a pivotal movement to the scraping rake. Experiments have shown that the apparatus in accordance with the invention is much more responsive to a bulging of the web than the known apparatus. As a result, in the apparatus in accordance with the invention the drive for the pair of feed rolls will be stopped even by a small bulge of the web and such bulges can be eliminated quickly and in a simple manner.

The tine carrier of the scraping rake is suitably connected to parallel guide rods, which are longitudinally displaceable and guided in bushings or sleeves which constitute linear ball bearings and are fixed in the frame of the apparatus. Such a movable mounting of the tine carrier or carriers with low friction will promote the sensitive response of the apparatus.

Those end portions of the guide rods which are disposed on the exit side of the feed rolls may be surrounded by compression springs, which are retained under stress between the linear ball bearing bushings on the exit side and the tine carrier or mounting parts connected to the tine carrier. At least one guide rod is suitably provided at its entrance-side end with a head plate or crosspiece, which will actuate a microswitch in response of an approach of said head plate or crosspiece to the linear ball bearing bushing on the entrance side.

The tines of the scraping rakes suitably extend through the grooves from the exit side of the pair of rolls and the free end portions of the tines on the entrance side are arcuately curved away from the plane of travel.

In accordance with an optional feature of the invention the tines of the scraping rake consist of air-blasting tubes and extend parallel to the plane of travel.

DETAILED DESCRIPTION OF THE PREFERRED EMBODIMENT

Figure 1:
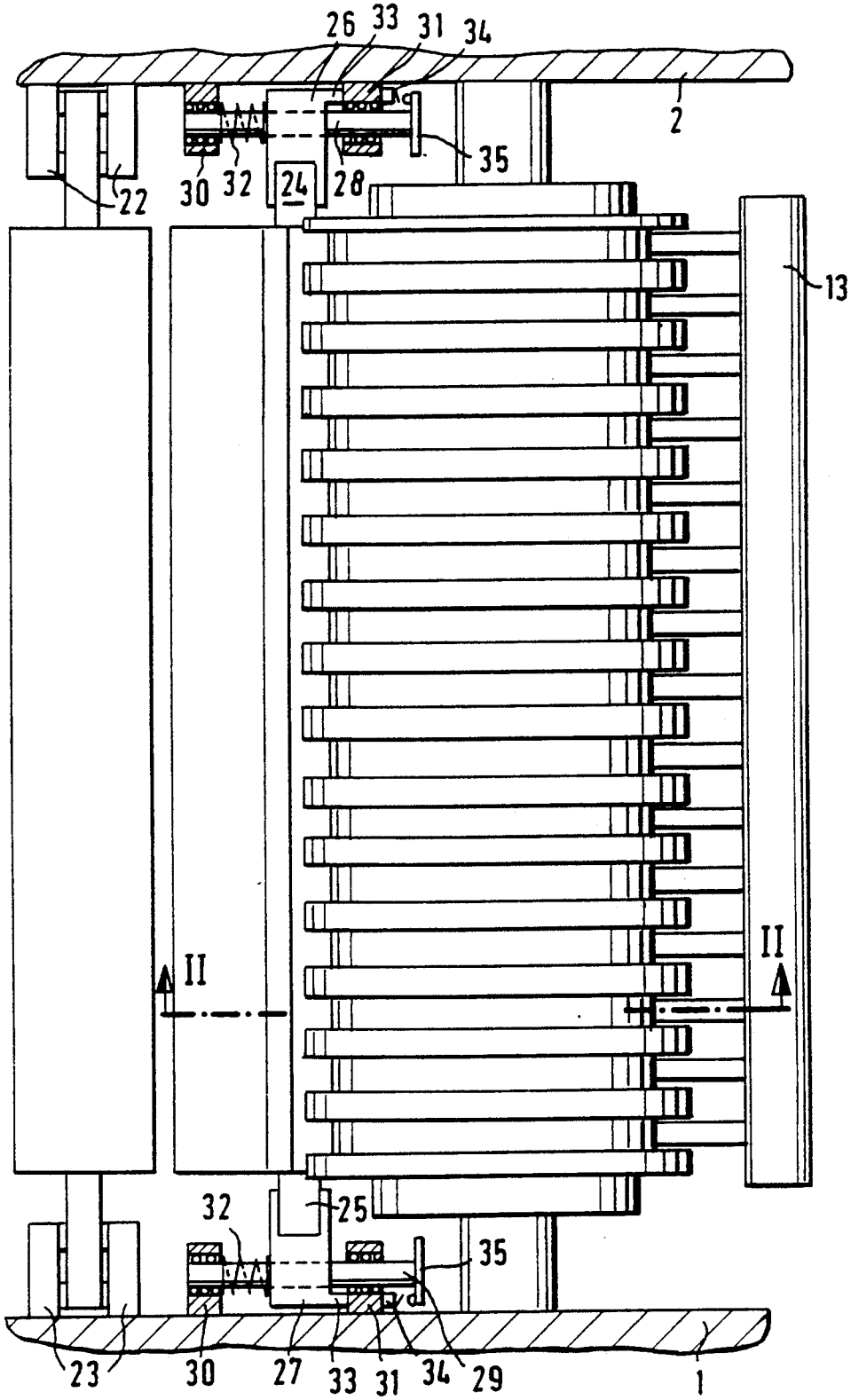
FIG. 1 is a top plan view showing the pair of feed rollers and a succeeding transverse welding and severing device.
Figure 2:
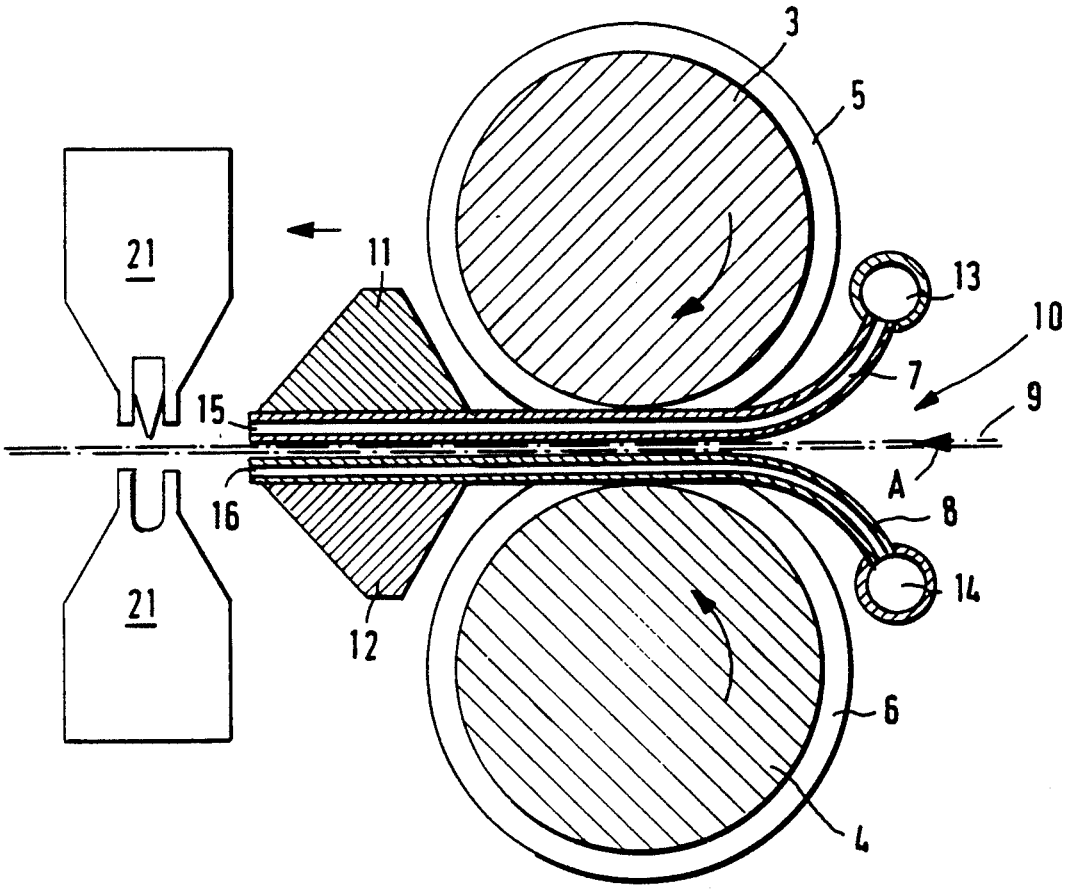
FIG. 2 is a side elevation showing the apparatus of FIG. 1 partly in a sectional view taken on line II—II in FIG. 1.

Feed rolls 3, 4 are movably mounted in known manner in the side walls 1, 2 of a machine frame and are connected to a conventional drive. The feed rolls 3 and 4 have peripheral annnular grooves 5 and 6. An upper rake 7 and a lower rake 8 are provided and have tines extending through the grooves 5 and 6, respectively. On the entrance side of the rolls 3 and 4, the tines of the rakes are curved to define an entrance gap 10 for receiving the plastic web 9. The tines of each rake are integrally connected to a tine carrier 11 or 12.

The tines of each rake 7 or 8 are tubular and connected to a compressed-air manifold 13 or 14. The tines of the rakes 7 and 8 are formed with orifices 15 and 16 for discharging air blasts by which the incoming plastic web 9 is guided to smoothly enter between the bottom and top jaws of transverse severing and welding apparatus 21. That severing and welding apparatus 21 has a known design. At least the top jaw is movable up and down in tracks 22 and 23, which are connected to the side frames 1 and 2.

It is apparent from FIG. 1 in that the two tine carriers 11 and 12 are provided with lateral extensions 24 and 25, which are fixedly connected to brackets 26 and 27. Said brackets are fixedly mounted on guide rods 28, 29. The guide rods 28, 29 are reciprocable in linear ball bearing bushings 30 and 31, which are fixed to the side frames 1 and 2. On one side of the brackets 26 and 27 the guides rods 28 and 29 are surrounded by compression springs 32, which urge the extensions 33 of the brackets 26 and 27 against the linear ball bearing bushings 31. The linear ball bearing bushings are provided with microswitches 34, which are operably by plates 35, each of which is fixed to one end of one of the guides rods 28 and 29. As soon as a bulge is formed in the web 9 adjacent to the tine carriers 11, 12, the tine carriers 11, 12 and the tines of the rakes 7, 8 are displaced in the direction of travel of the web 9, indicated by an arrow A, so that the plates 35 actuate the microswitches 34 and the machine is stopped immediately.

I claim:

1. An apparatus for feeding a web of synthetic thermoplastics, which apparatus comprises a pair of feed rolls in a frame, the rolls having an entrance side and an exit side defining a direction of travel of the web, a feeding nip on the entrance side of the rolls and each of which rolls is formed with annular grooves, and two scraping rakes, which are secured in the frame and have tines extending through the annular grooves, wherein at least one of said rakes is mounted in the frame for translatory movement lengthwise of the tines in the direction to travel of the web and arranged to actuate a switch for stopping the drive for the rolls when the scraping rake is moved out of its normal position by the web because it is bulged.

2. An apparatus according to claim 1, characterized in that each scraping rake comprises a tine carrier, which is connected to parallel guide rods, which are longitudinally displaceable and guided in bushings which constitute linear ball bearings and are fixed in the frame.

3. An apparatus according to claim 2, characterized in that end portions of the guide rods which are disposed on the exit side of the feed rollers are surrounded by compression springs, which are retained under stress between the linear ball bearing bushings on the exit side and the tine carrier.

4. An apparatus according to claim 2, characterized in that at least one guide rod is provided at one end with a head plate, which will actuate a microswitch in response of an approach of said head plate to the linear ball bearing bushing on the entrance side.

5. An apparatus according to claim 1, characterized in that the tines extend through the grooves form the exit side of pair or rolls and the free end portions of the tines on the entrance side are arcuately curved away from the plane of travel.

6. An apparatus according to claim 1, characterized in that the tines consist of air-blasting-tubes and extend parallel to a plane of travel of the web.

7. An apparatus according to claim 6, characterized in that the apparatus is arranged to feed the web to a closely succeeding transverse severing and welding device while the web is guided by air blasts discharged by said air-blasting tubes.

* * * * *